United States Patent [19]

Rysner et al.

[11] Patent Number: 5,002,187

[45] Date of Patent: Mar. 26, 1991

[54] MULTICOLOR BLISTER PACKAGE DISPLAY CARTON

[75] Inventors: Sheldon Rysner, Evanston, Ill.; Thomas Ramey, Appleton; Thomas Foster, Manitowoc, both of Wis.

[73] Assignee: Kaytee Products, Inc., Chilton, Wis.

[21] Appl. No.: 386,907

[22] Filed: Jul. 27, 1989

[51] Int. Cl.[5] ..... B65D 73/00

[52] U.S. Cl. ..... 206/461; 206/45.31; 206/459

[58] Field of Search ..... 206/44 R, 45.14, 45.28, 206/45.29, 45.31, 461, 464, 491, 492, 806, 459; 229/40, 87 A, 87.06

[56] References Cited

U.S. PATENT DOCUMENTS

| | | | |
|---|---|---|---|
| 1,759,470 | 5/1930 | Tanner | 206/45.29 |
| 3,459,298 | 8/1969 | Quenot | 206/45.31 |
| 3,487,915 | 1/1970 | Scott | 206/491 |
| 3,604,614 | 9/1971 | Sternfeld | 229/40 |
| 4,014,134 | 3/1977 | Womack, Jr. | 206/461 X |
| 4,140,218 | 2/1979 | Forte | 229/40 X |
| 4,257,522 | 3/1981 | Thorneburg | 206/806 X |
| 4,365,714 | 12/1982 | Doyel | 206/461 |

*Primary Examiner*—Bryon P. Gehman
*Attorney, Agent, or Firm*—Foley & Lardner

[57] ABSTRACT

A multicolor three-dimensional display carton is formed from a unitary blank having only one multicolor surface. The display carton is self-supporting and can be placed on a flat surface, or can be hung from a hook. The carton allows a portion of a displayed product to be viewed in a blister package mounted to a main panel while a portion of the displayed product is enclosed on all sides by panels with multicolored outwardly facing surfaces.

6 Claims, 3 Drawing Sheets

MULTICOLOR BLISTER PACKAGE DISPLAY CARTON

FIELD OF THE INVENTION

The present invention relates generally to paperboard display cartons and, in particular, to self-supporting, multicolor display cartons formed from a unitary blank having one multicolor surface.

BACKGROUND OF THE INVENTION

The use of multicolor paperboard display cartons is common. The use of such packages that are self-supporting and which allow the displayed product to be viewed by a consumer are also generally common. Although cartons of this general type have been produced, they tend to be of a rather complex nature and require use of a paperboard blank having two multicolor surfaces, which adds to the cost of packaging. There has been a need for a multicolor display carton of simple construction that is formed from a unitary paper blank having only one multicolor surface.

SUMMARY OF THE INVENTION

The multicolor display carton of the present invention is formed from a unitary blank having one multicolored surface and which includes a main panel, a base panel hingedly joined by a common scoreline to the main panel, a base panel folded against the main panel such that the main and base panels lie adjacent and face each other such that the respective multicolor surfaces face in opposing directions, a first side panel hingedly joined to the base panel on a first adjacent edge, a front panel hingedly joined to the first side panel on the edge opposite the base panel, a second side panel hingedly joined to the front panel on the edge opposite the first side panel, and a means of connecting the distal edge of the second side panel to the second adjacent edge of the base panel, whereby the base, first side, front, and second side panels enclose the main panel such that the exterior surfaces of the respective panels are multicolored. In this manner, a three dimensional display carton is formed from a flat blank which need be printed in multiple colors on one side only, while yielding a package on which the color decoration appears on all the surfaces which are seen by an observer.

It is a prime object of the present invention to form a three-dimensional multicolor carton from a unitary paperboard blank having a single multicolored surface.

It is a further object to provide a display carton whereby a portion of the displayed product is visible for inspection and the remaining portion of the displayed product is enclosed on four sides by multicolored surfaces.

A still further object is to provide a carton that is self-supporting.

Other objects, advantages, and features of the present invention will become apparent from the following specification when taken in conjunction with the accompanying drawings.

DESCRIPTION OF THE PREFERRED EMBODIMENT

Figure 1:
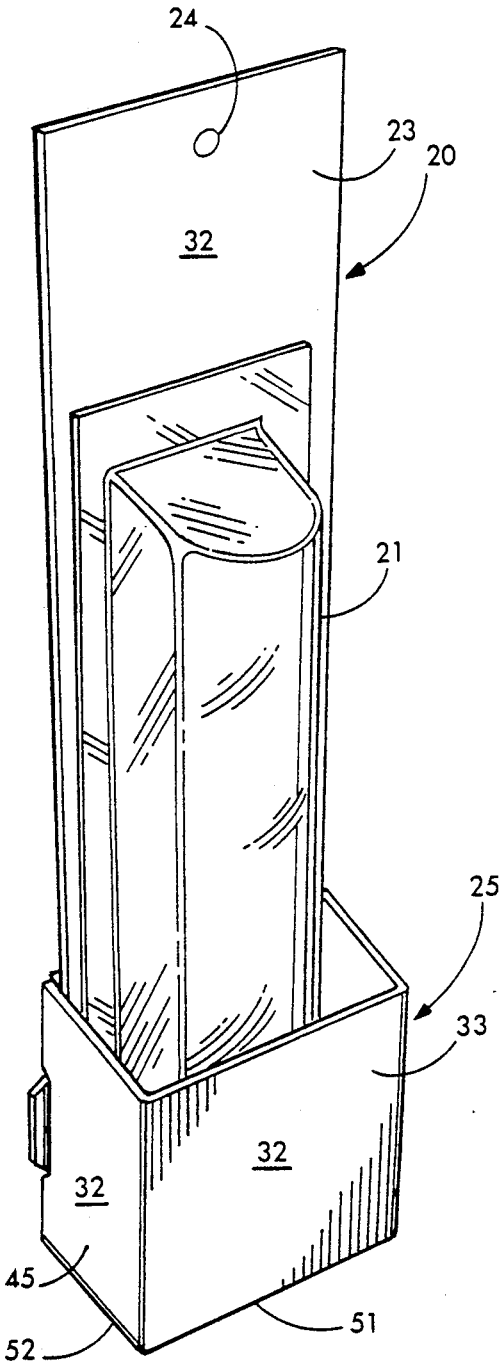
FIG. 1 is a perspective view of the display carton in its assembled form.

With reference to the drawings, a multicolored display carton, in accordance with the invention is shown generally at 20 in FIG. 1. The display carton 20 is shown in FIG. 1 in its self-supporting display position having a single compartment plastic blister package 21. The display carton 20 also has a hanging display position wherein a main panel 23 has a portion defining a hole 24 such that the display carton can be hung from a hook. The display carton 20 also has a base portion 25, described further below, which forms a three dimensional pedastal at the bottom of the carton to support the carton on a flat surface in the upright portion shown.

Figure 2:
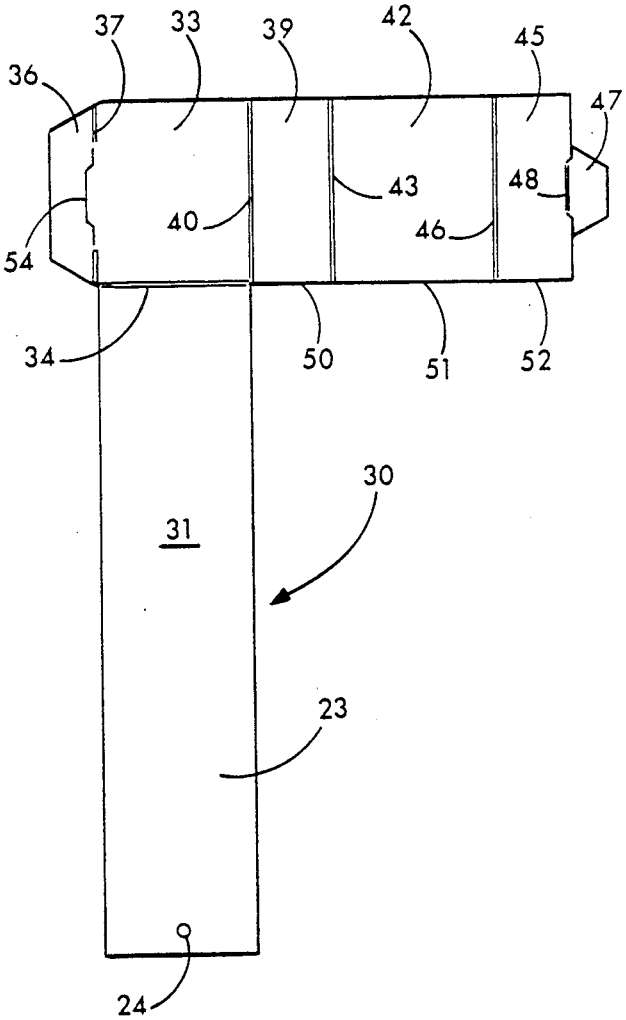
FIG. 2 is a plan view of a paperboard blank for use in constructing the display carton of FIG. 1.

With reference to FIG. 2, a substantially L-shaped paperboard blank, generally indicated at 30, is suitable for constructing the multicolored display carton 20. Forming one leg of the blank 30, which has its non-multicolored side or surface 31 shown in FIG. 2, is the substantially rectangular main panel 23. A flap insert 36 is hingedly joined by a scoreline 37 to a second edge of the base panel 33. A substantially rectangular base panel 33 is hingedly joined by a scoreline 34 to an edge of the main panel 23. A first side panel 39 is hingedly joined by a scoreline 40 to a third edge of the base panel 33 opposite to the edge 37. A substantially rectangular front panel 42 is hingedly joined by a scoreline 43 to the first side panel 39 on the edge opposite the scoreline 40. A substantially rectangular second side panel 45 is hingedly joined by a scoreline 46 to the front panel 42 on the edge opposite the scoreline 43. A tuck flap 47 is joined hingedly by a scoreline 48 to the second side panel 45 on the edge opposite the scoreline 46. The scoreline 43 is co-linear with a side edge 50 of the first side panel 39, a side edge 51 of the front panel 42, and side edge 52 of the second side panel 45, such that when the carton is assembled, the carton will be self-supporting when placed on a flat surface with the scoreline 34 and side edges 50, 51 and 52 defining the bottom of the carton.

Figure 3:
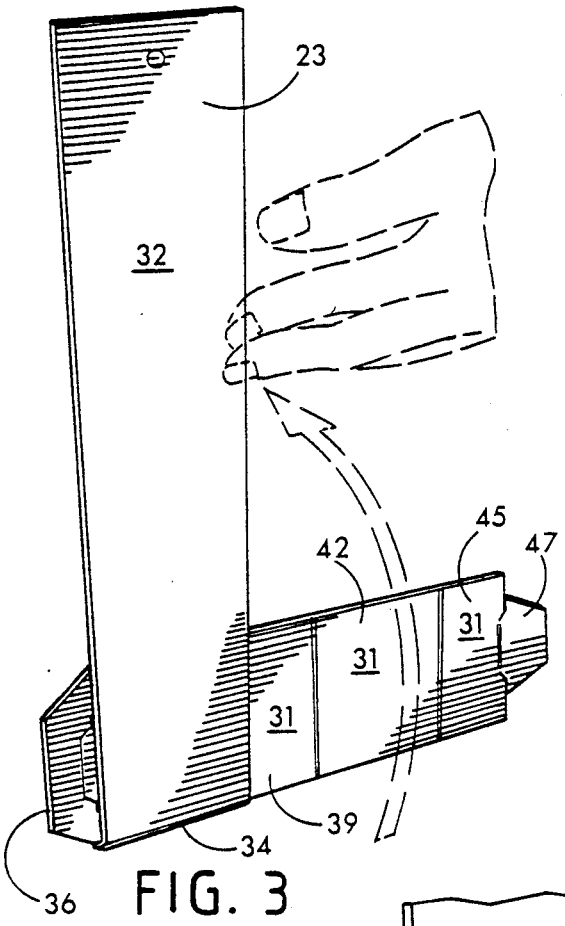
FIG. 3 is an illustrative view of the carton of the invention in a partially assembled state.
Figure 4:
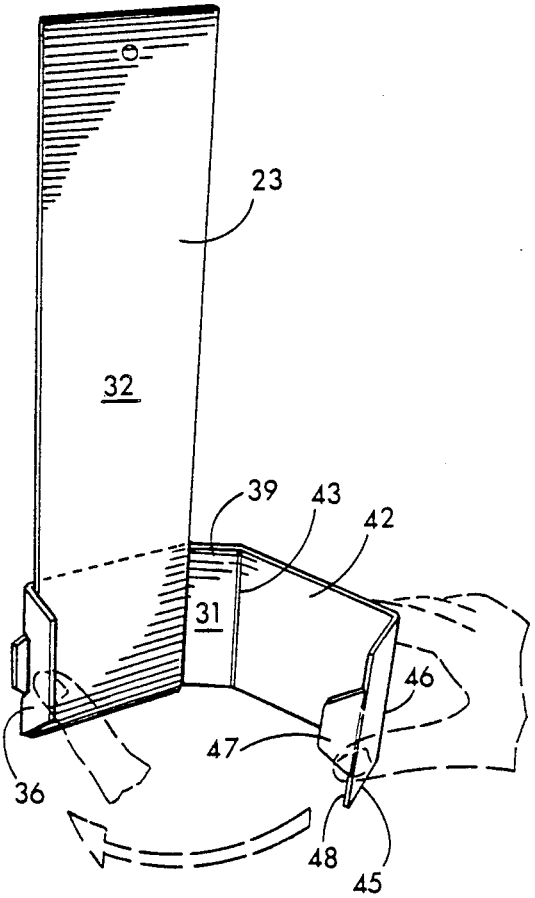
FIG. 4 is an illustrative view of the carton in a further assembled state.
Figure 5:
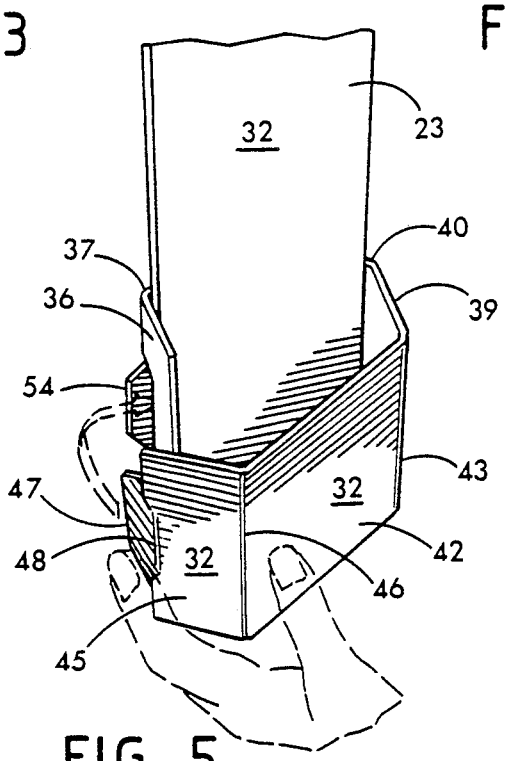
FIG. 5 is an illustrative view of the carton in the still further assembled state.

In assembling the carton 20 of FIG. 1 from the blank 30 of FIG. 2, it is first necessary to fold the main panel 23 along the scoreline 34 so that the main panel 23 and the base panel 33 lie adjacent and facing each other, such that the respective multicolor surfaces face in opposite directions, with the multicolored or decorated surface 32 of the blank (the surface opposite the surface 31) of the main panel now facing the same direction as the surface 31 of the panels 39, 42 and 45, as shown in FIG. 3. Then the carton 20 is further assembled by folding the first side panel 39 relative to the main panel 23 and base panel 33 along the scoreline 40 until it is perpendicular thereto, and then folding the front panel 42 along the scoreline 43 until it is perpendicular to the first side panel 39, and then folding the second side panel 45 along the scoreline 45 until it is perpendicular to the front panel 42. At this point, the scoreline 48, attaching the tuck flap 47 to the second side panel 45, lies adjacent the scoreline 37 attaching the flap insert 36 to the base panel 33, and the tuck flap 47 may be folded relative to the second side panel 45 until it is perpendicular thereto and then the tuck flap 47 inserted into the opening 54 cut in the flap insert 36, wherein a lower portion of the main panel 23 is enclosed on all sides by the base panel 33, the first side panel 39, the front panel 42, and the second side panel 45, such that the exterior surfaces of these respective panels are the multicolor surface 32, as shown in FIG. 5.

Figure 6:
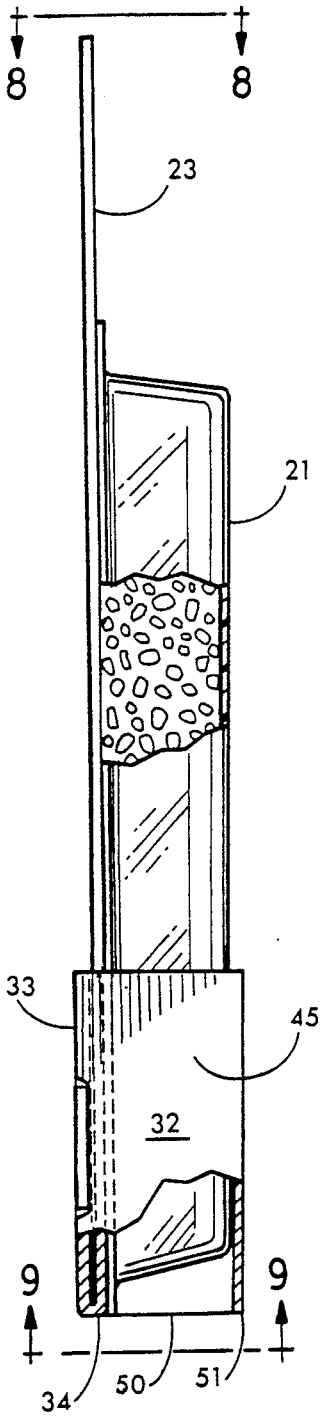
FIG. 6 is a side view of the carton of the invention having a single compartment blister package mounted thereon.
Figure 7:
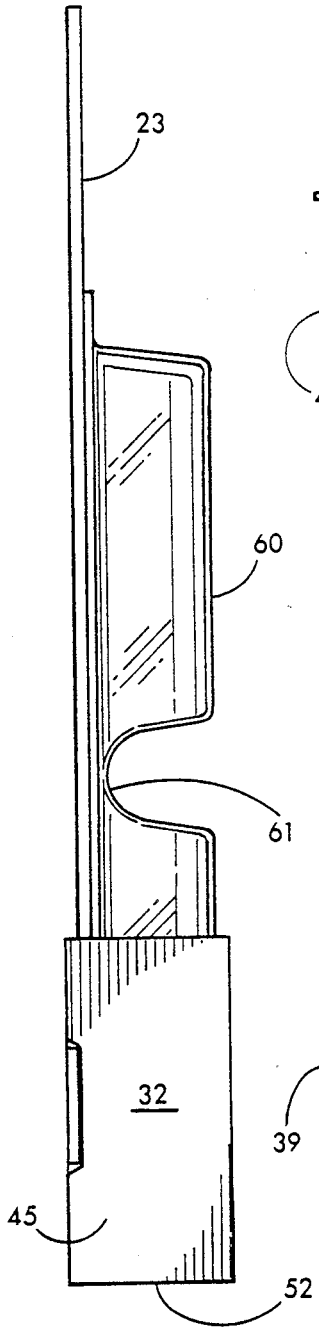
FIG. 7 is a side view of the carton of the invention having a double compartment blister package mounted thereon.
Figure 8:
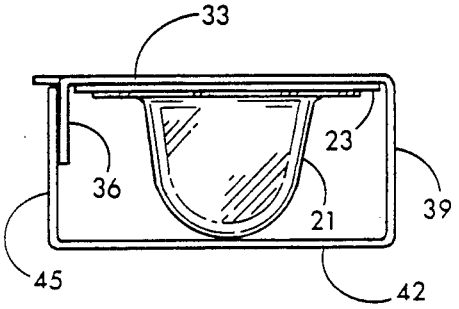
FIG. 8 is a top view of the carton of FIG. 6.
Figure 9:
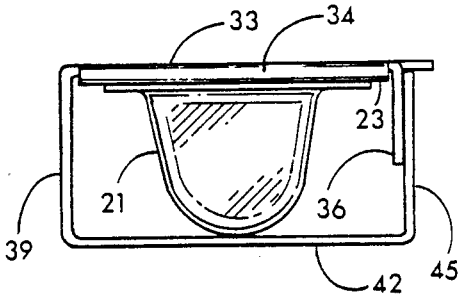
FIG. 9 is a bottom view of the carton of FIG. 6.

As may be seen in FIG. 6, the transparent, tubular, plastic blister package enclosure 21 is mounted on the main panel 23 such that a product may be displayed. FIG. 6 shows a single compartment blister package 21, and FIG. 7 shows a double compartment blister package 60 with a central depression 61 which divides the blister 60 in half to form two compartments for two separate products. The plastic blisters 21 and 60 may be glued onto the colored surface 31 of the main panel 23 while the blank 30 is flat, with the blister enclosing the desired product to mount it to the carton. The carton may then be assembled as described above. When the carton 20 is assembled, a lower portion of the blister package 21 or 60 is enclosed on all sides by the base panel 33, the first side panel 39, the front panel 42, and the second side panel 45, such that the exterior surfaces of these respective panels are the multicolor surface 32.

As may be seen in FIGS. 1 and 2, co-linearity between the scoreline 34 and the edges 50, 51, and 52 dictates that the bottom edges of the assembled carton 20 are coplanar, whereby the assembled carton 70 is self-supporting in an upright position when placed on a flat surface. An alternative display method allows the carton 20 to be hung from a hook, placed through the mounting hole 24.

It is understood that the present invention is not limited to the particular construction and arrangement of parts illustrated and described herein, but embraces all such modified forms thereof as come within the scope of the following claims.

What is claimed is:

1. A multicolor display carton formed from a unitary blank having one multicolor surface comprising:

(a) a rectangular main panel having edges and a multicolored surface;

(b) a blister package mounted to the multicolored surface of the main panel;

(c) a base panel joined by a scoreline to an edge of the main panel, the base panel folded about the scoreline to lie against the main panel such that the base and main panels lie adjacent each other and such that the respective multicolor surfaces of each panel face in opposite directions;

(d) a first side panel joined to the base panel on an edge of the base panel adjacent to the edge by which the main panel is joined to the base panel;

(e) a front panel joined to the first side panel on an edge of the first side panel opposite to the edge by which the first side panel is joined to the base panel;

(f) a second side panel joined to the front panel on an edge of the front panel opposite the edge by which the front panel is connected to the first side panel, the second side panel having an opposite distal edge; and (g) means for connecting the distal edge of the second side panel to the edge of the base panel opposite to the edge by which the first side panel is joined to the base panel, such that the base panel, first side panel, front panel, and second side panel enclose a portion of the main panel and a portion of the blister package and the exterior surfaces of the base panel, front panel and side panel are mutlicolored.

2. The carton of claim 1 wherein the main and base panels are joined by a scoreline which is co-linear with the adjacent edges of the first side panel, front panel, and second side panel such that the bottom edges of the carton are co-planar and the structure is self-supporting.

3. The carton of claim 1 wherein the means for connecting comprises a tuck flap hingedly joined to the distal edge of the second side panel which is inserted into a flap insert hingedly joined to the edge of the base panel.

4. The carton of claim 1 wherein the blister package comprises a transparent single compartment blister package which is glued to the main panel.

5. The carton of claim 1 wherein the blister package comprises a transparent double compartment blister package which is glued to the main panel.

6. The carton of claim 1 including a hole formed in the main panel such that the carton can hang from a hook in an upright position.

* * * * *